US009816367B2

(12) United States Patent
Arellano et al.

(10) Patent No.: US 9,816,367 B2
(45) Date of Patent: Nov. 14, 2017

(54) SYSTEM, APPARATUS AND METHOD FOR WELL DELIQUIFICATION

(71) Applicant: Chevron U.S.A. Inc., San Ramon, CA (US)

(72) Inventors: Jose Luis Arellano, Houston, TX (US); Emee Ermel, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 486 days.

(21) Appl. No.: 14/464,221

(22) Filed: Aug. 20, 2014

(65) Prior Publication Data

US 2015/0053410 A1 Feb. 26, 2015

Related U.S. Application Data

(60) Provisional application No. 61/869,315, filed on Aug. 23, 2013.

(51) Int. Cl.

| | |
|---|---|
| ***E21B 43/38*** | (2006.01) |
| ***E21B 43/295*** | (2006.01) |
| ***E21B 43/12*** | (2006.01) |

(52) U.S. Cl.

CPC ..... *E21B 43/38* (2013.01); *E21B 43/121* (2013.01)

(58) Field of Classification Search

CPC ..... E21B 43/38; E21B 43/385; E21B 43/121; E21B 43/40

(Continued)

(56) References Cited

U.S. PATENT DOCUMENTS 3,216,368 A * 11/1965 Waldron ..... F04F 5/02 417/170

7,051,817 B2 5/2006 Shaposhnikov et al.

(Continued)

FOREIGN PATENT DOCUMENTS

| | | |
|---|---|---|
| CN | 201074508 | 6/2008 |
| CN | 202832448 | 3/2013 |

(Continued)

OTHER PUBLICATIONS

Search Report, dated Oct. 7, 2014, during the prosecution of Application No. GB1414759.9.

(Continued)

*Primary Examiner* — David Bagnell
*Assistant Examiner* — Nikhil Menon

(57) ABSTRACT

Embodiments of an apparatus, a system, and a method are provided for deliquification of a production well. The apparatus can be a production tube that receives produced fluid from a subterranean reservoir and provides a pathway for transmission of the produced fluid to a surface location. The production tube includes a nozzle disposed therewithin and an opening positioned proximate to the nozzle through which a foaming agent is introduced into the production tube. The nozzle has a first end that defines an inlet, a second end distal to the first end that defines an outlet, and a passageway extending between the first end and the second end such that the produced fluid received by the inlet is delivered to the outlet. The passageway defines a region of decreased cross-sectional area that agitates the produced fluid passing through the nozzle thereby increasing mixing of the foaming agent.

20 Claims, 4 Drawing Sheets

(58) Field of Classification Search
USPC ..... 166/309
See application file for complete search history.

(56) References Cited

U.S. PATENT DOCUMENTS

| | | | | |
|---|---|---|---|---|
| 7,147,058 | B1 * | 12/2006 | Shaposhnikov | E21B 43/122 166/105 |
| 7,287,597 | B2 * | 10/2007 | Shaposhnikov | E21B 43/121 166/372 |
| 7,506,690 | B2 * | 3/2009 | Kelley | E21B 43/121 166/106 |
| 8,122,966 | B2 * | 2/2012 | Kelley | E21B 43/122 166/106 |
| 9,062,538 | B2 | 6/2015 | Arellano et al. | |
| 2004/0129428 | A1 | 7/2004 | Kelley | |
| 2009/0151953 | A1 * | 6/2009 | Brown | E21B 43/122 166/335 |
| 2009/0242208 | A1 * | 10/2009 | Bolding | E21B 43/10 166/371 |
| 2009/0321083 | A1 * | 12/2009 | Schinagl | E21B 43/121 166/372 |
| 2010/0051288 | A1 * | 3/2010 | Gaudette | E21B 34/08 166/372 |
| 2011/0024130 | A1 * | 2/2011 | Barry | E21B 43/121 166/372 |
| 2011/0067883 | A1 | 3/2011 | Falk et al. | |
| 2013/0092373 | A1 * | 4/2013 | Arellano | E21B 43/121 166/267 |

FOREIGN PATENT DOCUMENTS

| | | |
|---|---|---|
| CN | 202832448 U | 3/2013 |
| EP | 0247754 | 10/1990 |
| GB | 2419905 | 5/2006 |

OTHER PUBLICATIONS

White, Aaron; "Downhole Choke Applications & Performance Impact: *A Murphy Montney Evaluation*"; Article, SPE-171598, Murphy Oil Company, pp. 1-37, date not provided on the article.

White, Aaron, et al.; "Downhole Choke Applications & Performance Impact: *A Tupper Field Montney Evaluation*"; Article, SPE-171598, Murphy Oil Company, pp. 1-24, Sep. 30-Oct. 2, 2014.

Tek, M. Rasin, et al.; "Temperature and Pressure Gradients in Gas Wells"; SPE 7495, Oct. 1978, pp. 1-6 and Table 1.

* cited by examiner

SYSTEM, APPARATUS AND METHOD FOR WELL DELIQUIFICATION

CROSS-REFERENCE TO RELATED APPLICATIONS

The present application claims priority from U.S. Provisional Application No. 61/869,315, filed on Aug. 23, 2013, the disclosure of which is hereby incorporated by reference in its entirety.

TECHNICAL FIELD

The present disclosure relates to deliquification of gas production wells, and more particularly, to an artificial lift system and method for deliquification of gas production wells by injecting foaming agents adjacent to a nozzle through which production fluids are recovered.

BACKGROUND

Fluids produced from wells often include multiple phases. For example, a conventional gas well can be used to produce hydrocarbon gases from a subterranean reservoir to a surface location. The reservoir where the gas is found may also contain liquids, such as water or hydrocarbon liquids. In a typical completion of a gas well, a tubular casing having one or more radial layers is disposed from the surface location to or through the reservoir. A production tube or string, typically a steel pipe, is disposed within the casing, typically with an annulus defined between the outside of the production tube and the innermost well casing. At depth, the outer surface of the production tube is sealed to the inner surface of the casing by packers so that the production tube provides a pathway from the reservoir to the surface location, and all produced fluid flowing through the well from the reservoir to the surface location flows through the production tube. The casing is perforated to admit the produced fluid from the reservoir into the production tube.

Gas and liquid that are present in the reservoir may enter the casing. During a typical operation of a gas well, the level of water or other liquids in the casing is below the inlet of the production tube. Nevertheless, the flow of gas into the production tube may carry some liquid with it, a phenomenon referred to as "liquid loading" of the produced gas. Liquid loading can occur in different ways. For example, if liquid resides in the casing and the upper level of the liquid is near the inlet of the production tube, the flow of the gas into the production tube may disturb the upper level of the liquid and draw the liquid into the production tube. In fact, the upper level of the liquid in the immediate vicinity of the production tube may be temporarily pulled up to the inlet of the production tube. The liquid may temporarily block the gas from entering the production tube. In this way, a distinct "slug" of liquid may be drawn into the tube before the level of the liquid in the casing falls back down, and the slug then passes upward through the tube with the gas.

Alternatively, even if the upper level of the liquid remains below the inlet of the production tube, the gas may carry some liquid. In some cases, the liquid can be carried first in a gaseous phase, e.g., as water vapor, that liquefies as the produced fluid travels through the production tube. As the vapor liquefies, it can form a mist, i.e., small droplets suspended in the gas. Mist-like droplets of the liquid can also be present in the gas as it enters the production tube. In either case, the droplets of liquid typically tend to combine and form larger drops of liquid in the produced fluid. Thus, as the produced fluid travels through the production tube, the liquid content may increase and may become more difficult to lift, thereby reducing the flow rate of the well. The liquid content in the produced fluid may even stop the production of gas from the well until sufficient pressure builds.

There are several conventional methods for deliquification of a gas well such as by direct pumping (e.g., sucker rod pumps, electrical submersible pumps, progressive cavity pumps). Another common method is to run a reduced diameter (e.g., 0.25 to 1.5 inches) velocity or siphon string into the production well. The velocity or siphon string is used to reduce the production flow area, thereby increasing gas flow velocity through the string and attempting to carry some of the liquids to the surface as well. Another alternative method is the use of plunger lift systems, where small amounts of accumulated fluid is intermittently pushed to the surface by a plunger that is dropped down the production string and rises back to the top of the wellhead as the well shutoff valve is cyclically closed and opened, respectively. Another method is gas lift, in which gas is injected downhole to displace the well fluid in production tubing string such that the hydrostatic pressure is reduced and gas is able to resume flowing. Additional deliquification methods previously implemented include adding wellhead compression and injection of soap sticks or foamers.

Although there are several conventional methods for removing liquids from a well, there exists a continued need for improvements to produce fluids from a well, particularly in the production of gas from reservoirs that include liquid content.

SUMMARY

The present disclosure provides embodiments of an apparatus, system, and method for deliquification of production wells.

According to one embodiment, the apparatus is provided as a production tube that receives produced fluid from a subterranean reservoir and provides a pathway for transmission of the produced fluid to a surface location. The production tube has a nozzle disposed therewithin and an opening positioned proximate to the nozzle through which a foaming agent is introduced into the production tube. The nozzle has a first end that defines an inlet, a second end distal to the first end that defines an outlet, and a passageway extending between the first end and the second end such that the produced fluid received by the inlet is delivered to the outlet. The passageway defines a region of decreased cross-sectional area that agitates the produced fluid passing through the nozzle thereby increasing mixing of the foaming agent.

According to another embodiment, the system is provided as a production tube, at least one nozzle, and an injection line. The production tube receives produced fluid from a subterranean reservoir and provides a pathway for transmission of the produced fluid to a surface location. The nozzle is disposed within the production tube and has a first end that defines an inlet, a second end distal to the first end that defines an outlet, and a passageway extending between the first end and the second end such that produced fluid received by the inlet are delivered to the outlet. The passageway defines a region of decreased cross-sectional area that reduces the pressure of the produced fluid passing through the nozzle. The injection line delivers a foaming agent into the production tube proximate to nozzle such that mixing of the foaming agent is increased within the production tube due to agitation of the produced fluid passing through the nozzle.

According to another embodiment, the method includes providing a production tube and at least one nozzle disposed within the production tube. The production tube extends from a subterranean reservoir to a surface location. The nozzle has a first end that defines an inlet, a second end distal to the first end that defines an outlet, and a passageway extending between the first end and the second end such that produced fluid received by the inlet is delivered to the outlet. The passageway defines a region of decreased cross-sectional area that reduces the pressure of the produced fluid passing through the nozzle. The produced fluid is received through the production tube along a pathway between the reservoir and the surface location such that the produced fluid passes through the nozzle. A foaming agent is delivered into the production tube proximate to the nozzle such that mixing of the foaming agent is increased within the production tube due to agitation of the produced fluid passing through the nozzle.

DETAILED DESCRIPTION

The present invention now will be described more fully hereinafter with reference to the accompanying drawings, in which some embodiments, but not all embodiments of the invention are shown. Indeed, this invention may be embodied in many different forms and should not be construed as limited to the embodiments set forth herein; rather, these embodiments are provided so that this disclosure will be thorough and complete, and will fully convey the scope of the invention to those skilled in the art. For example, the present disclosure provides embodiments of an apparatus, system, and method for deliquification of production wells. Like numbers refer to like elements throughout.

Figure 1:
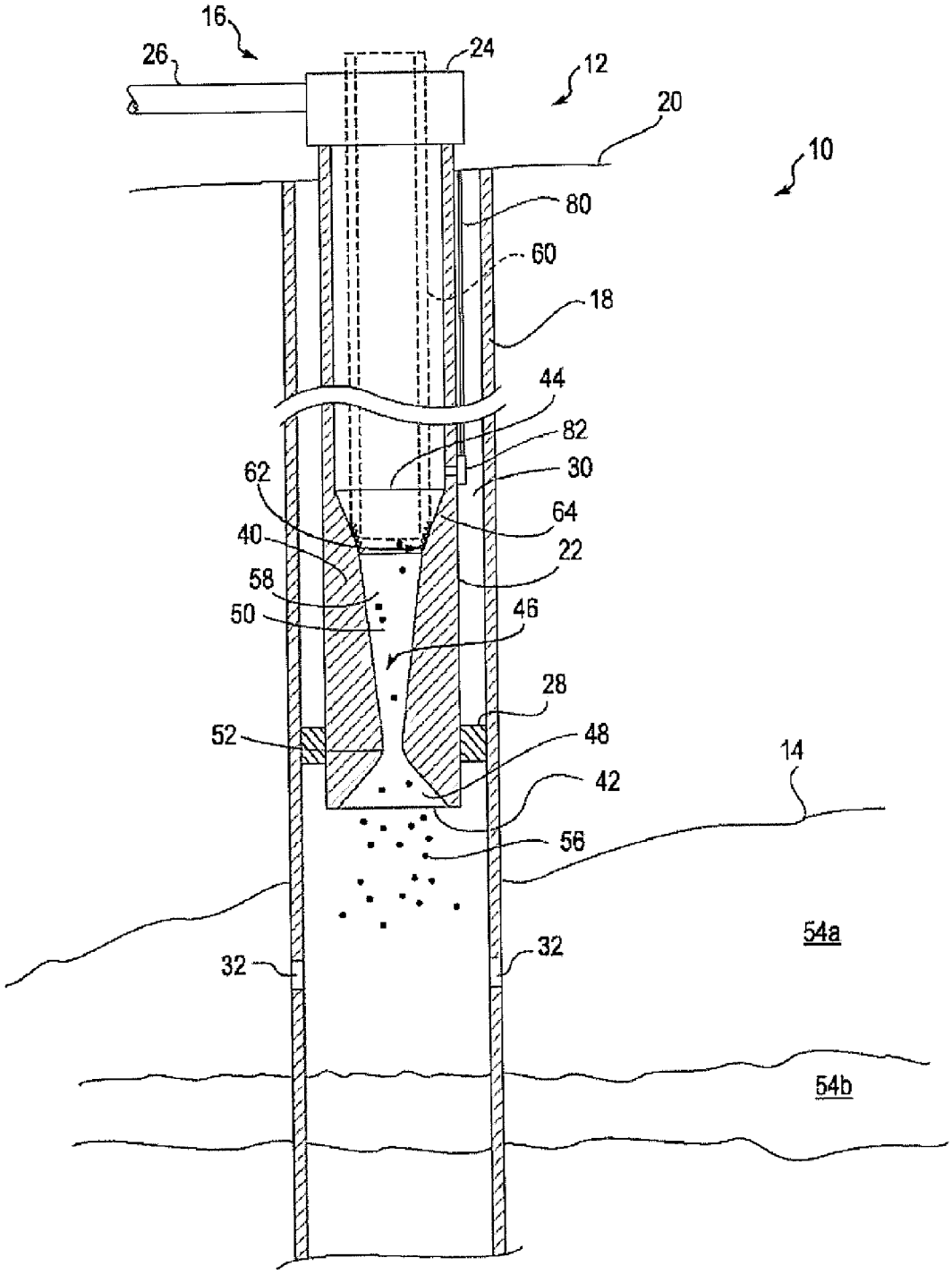
FIG. 1 is cross-sectional view illustrating a deliquification arrangement for a production well.

Referring to FIG. 1, there is shown a system 10 for deliquefying a produced fluid that is being produced from a gas well 12 that produces a stream of produced fluid from a subsurface gas reservoir 14 to a surface location 16. Reservoir 14 can be any type of subsurface formation in which hydrocarbons are stored, such as limestone, dolomite, oil shale, sandstone, or a combination thereof. Furthermore, the reservoir 14 may include a plurality of zones (e.g., a plurality of producing zones) and the produced fluid may come from any or all of the zones of the plurality of zones. Alternatively, the reservoir 14 may not include a plurality of zones (e.g., in which case the reservoir 14 may simply be a producing zone) and the produced fluid may simply come from the reservoir 14. The produced fluid may include practically any fluid that may come from the reservoir 14. The well 12 generally includes a casing 18 that extends from the surface location 16 downward from the ground surface 20 at least to the depth of the reservoir 14. The casing 18 may include one or more radially concentric layers, though a single layer is shown in FIG. 1 for illustrative clarity. Also, while the casing 18 is arranged in a linear and vertical configuration in FIG. 1, it is appreciated that the well 12 can be otherwise configured, e.g., extending at an angle or defining curves or angles so that different portions of the well 12 extend along different directions. For example, in some cases, the well 12 can include portions that are generally vertical in configuration and/or portions that are generally horizontal in configuration. Furthermore, the well 12 can be completed in any manner (e.g., a barefoot completion, an openhole completion, a liner completion, a perforated casing, a cased hole completion, a conventional completion).

A production tube 22, which is typically made up of steel pipe segments welded end-to-end, is disposed in the casing 18. The production tube 22 extends from the reservoir 14 to the surface location 16 (i.e., ground surface or platform surface in the event of an offshore production well). The production tube 22 is configured to receive the produced fluid from the reservoir 14 and transmit the produced fluid to the surface location 16. A Christmas tree or other wellhead equipment 24 can be connected to the production tube 22 at the surface location 16 and configured to receive the produced fluid for processing, storage, and/or further transport. For example, the wellhead equipment 24 can be connected to a flowline 26 that delivers the produced fluid from the well 12 to a processing or storage facility.

The production tube 22 can be sealed from the casing 18 by one or more packers 28. Each packer 28 extends circumferentially around the production tube 22 and radially between the outer surface of the production tube 22 and an inner surface of the innermost casing 18. In this way, the produced fluid can be prevented from flowing through the annulus 30 between the production tube 22 and the casing 18. Instead, the produced fluid flows through the production tube 22, as controlled by the wellhead equipment 24. Perforations 32 in the casing 18 allow the fluids from the reservoir 14 to flow into the casing 18, and, if the pressure in the reservoir 14 is sufficient, the reservoir pressure can cause the fluid to be produced through the well 12 to the wellhead equipment 24 at the surface location 16.

As illustrated in FIG. 1, a nozzle 40 is disposed in the production tube 22. The nozzle 40 defines a flow path for the produced fluid along the axial axis of the nozzle 40 and is generally configured to receive the produced fluid through a first end 42 that defines a nozzle inlet and deliver the produced fluid to a second, opposite end 44 that defines a nozzle outlet. For example, the second end 44 may be distal to the first end 42. An inner surface 46 of the nozzle 40 extends between the first and second ends 42, 44 and defines a path or passageway such that fluids received by the inlet are delivered to the outlet. The passageway defines a region of decreased cross-sectional area that agitates (e.g., alters velocity of the flow, alters the pressure, deliquefies) fluids passing through the nozzle. The passageway typically has a non-uniform cross-sectional area. For example, as shown in FIG. 1, the inner surface 46 defines an inwardly tapered inlet portion 48 at the first end 42, an outwardly tapered outlet portion 50 proximate the second end 44, and a venturi neck portion 52 between the tapered inlet and outlet portions 48, 50. Thus, as fluid flows through the nozzle 40, the fluid encounters a cross-sectional area that first decreases in the inlet portion 48 and then increases in the outlet portion 50. The inner surface 46 is typically a smooth, continuously, curved nozzle surface.

While the present invention is not limited to a particular theory of operation, it is believed that the nozzle 40 can facilitate the flow of produced fluid through the production tube 22 by increasing the speed of the flow of produced fluid, reducing the pressure of the produced fluid, and causing the produced fluid to deliquefy as it passes through the nozzle 40. By "deliquefy," it is meant that liquid drops in the produced fluid are caused to become reduced in size and/or turn to a gaseous form, such that the produced fluid exiting the nozzle 40 is better able to flow upward in the production tube 22.

The reservoir 14 can include gas 54*a*, such as natural gas, as well as liquids 54*b*, such as water. In a typical operation, the produced fluid for a gas well can be primarily gas, such as natural gas. The produced fluid may include a small water component, and the water may exist as vapor and/or droplets suspended in the gas. As the produced fluid flows upward through the production tube 22, the water content may tend to liquefy, i.e., vaporous water may turn to liquid droplets and/or small droplets of water may coalesce to form larger water drops, thereby inhibiting the flow of the produced fluid. As illustrated in FIG. 1, the water drops (generally indicated by reference numeral 56) in the produced fluid entering the nozzle 40 are deliquefied in the nozzle 40, such that the produced fluid exiting the nozzle 40 is characterized by less liquid content and/or smaller sized droplets as compared to the produced fluid entering the nozzle 40. In some cases, the produced fluid may enter the nozzle 40 as a gas that includes water drops and exit the nozzle 40 as a mist of gas that includes small water droplets suspended therein and/or an increased level of water vapor (generally indicated by reference numeral 58). Although water, water droplets, and water vapor are discussed in this example, this disclosure is not limited to this example and other items in the produced fluid may be deliquefied in a similar manner.

Foaming agent is introduced into the production tube 22 through injection line 80 and injection valve 82. Injection line 80 can be a capillary tube, or another tubing arrangement, disposed in annulus 30. Injection valve 82 is in fluid communication with injection line 80 and production tube 22, prevents backflow inside the injection line 80, and allows for controlled injection volumes to be applied to production tube 22. For example, injection valve 82 can be a spring-loaded differential valve. Injection line 80 can receive foaming agent from equipment (not shown) on the surface location 16 as a batch treatment or a continuous application. The surface equipment can include, for example, a chemical supply tank, chemical pump, and other conventional chemical injection equipment (e.g., valves, controllers, gauges). Foaming agent (also referred to in the petroleum industry as "foamers") reduces the surface tension and fluid density of fluids in the production tube 22, thereby reducing the hydrostatic pressure in the production tube 22 and allowing for unloading and improved production rates of fluids from the producing zone of the reservoir 14. Examples of foaming agents include, but are not limited to, surfactants such as betaines, amine oxides, sulfonates (e.g., alpha-olefin sulfonates), and sulfates (e.g., lauryl sulfates).

Figure 2:
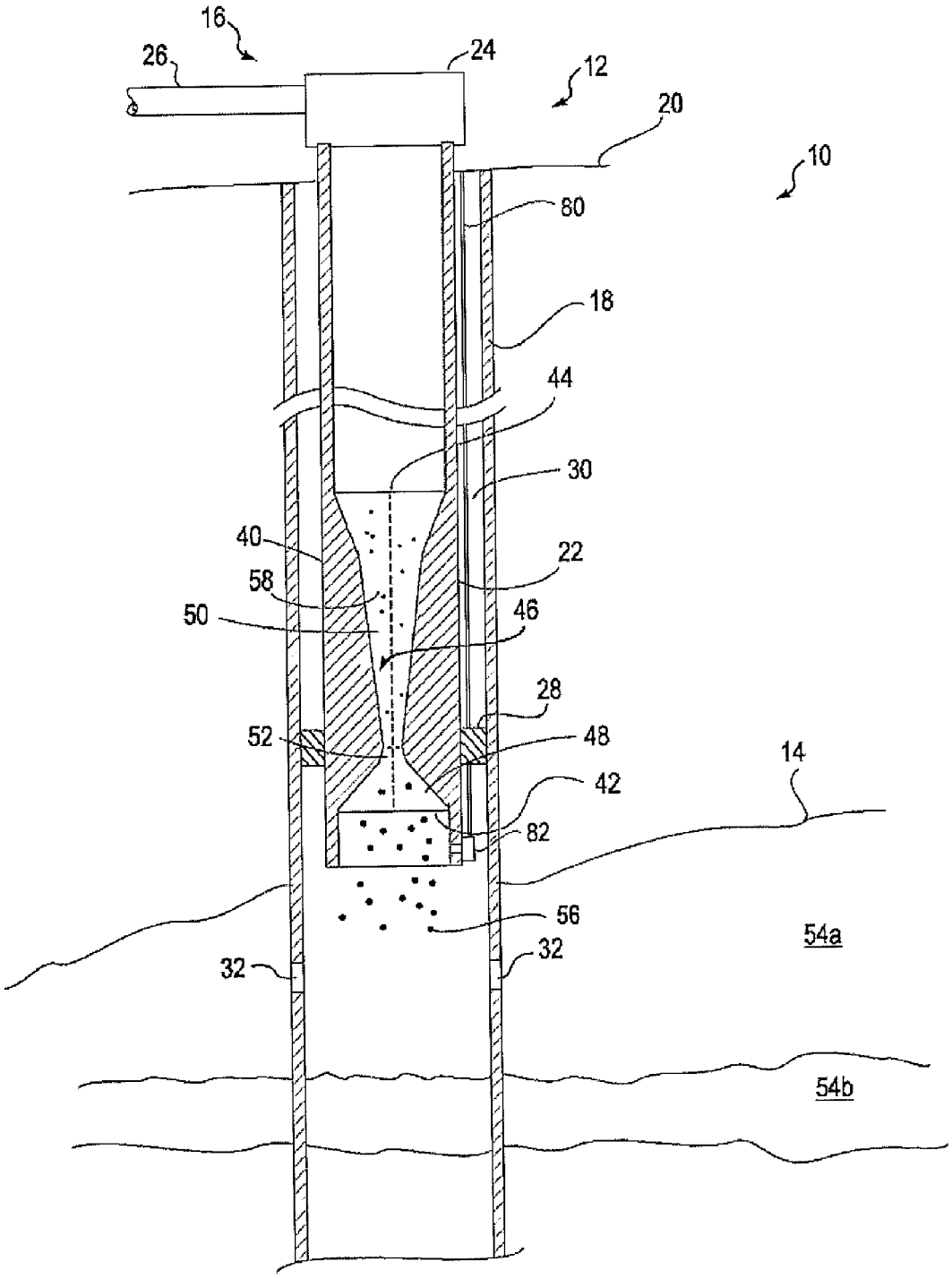
FIG. 2 is a cross-sectional view illustrating a deliquification arrangement for a production well where a nozzle is integral with the production tube.
Figure 3:
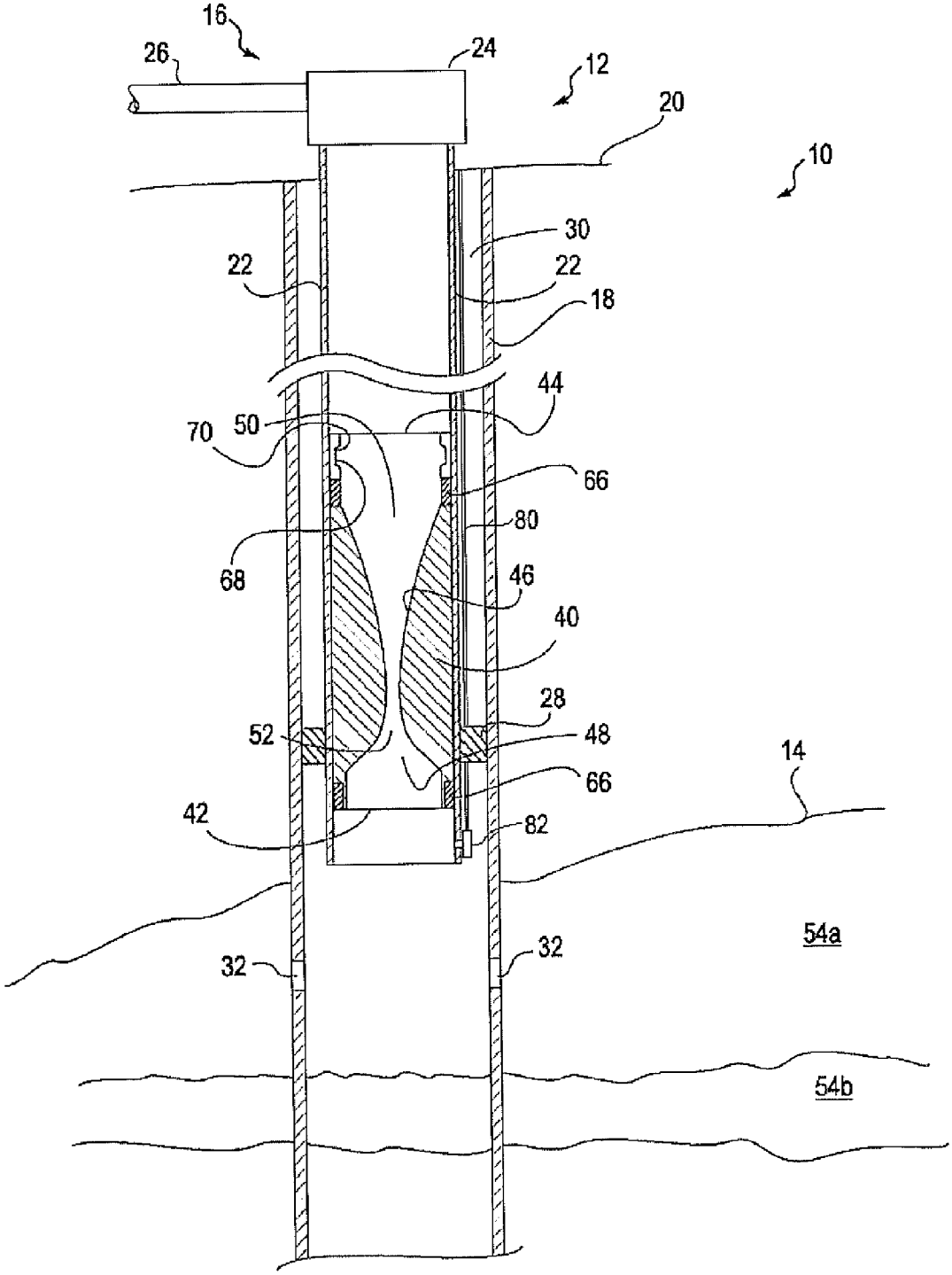
FIG. 3 is cross-sectional view illustrating a deliquification arrangement for a production well.
Figure 4:
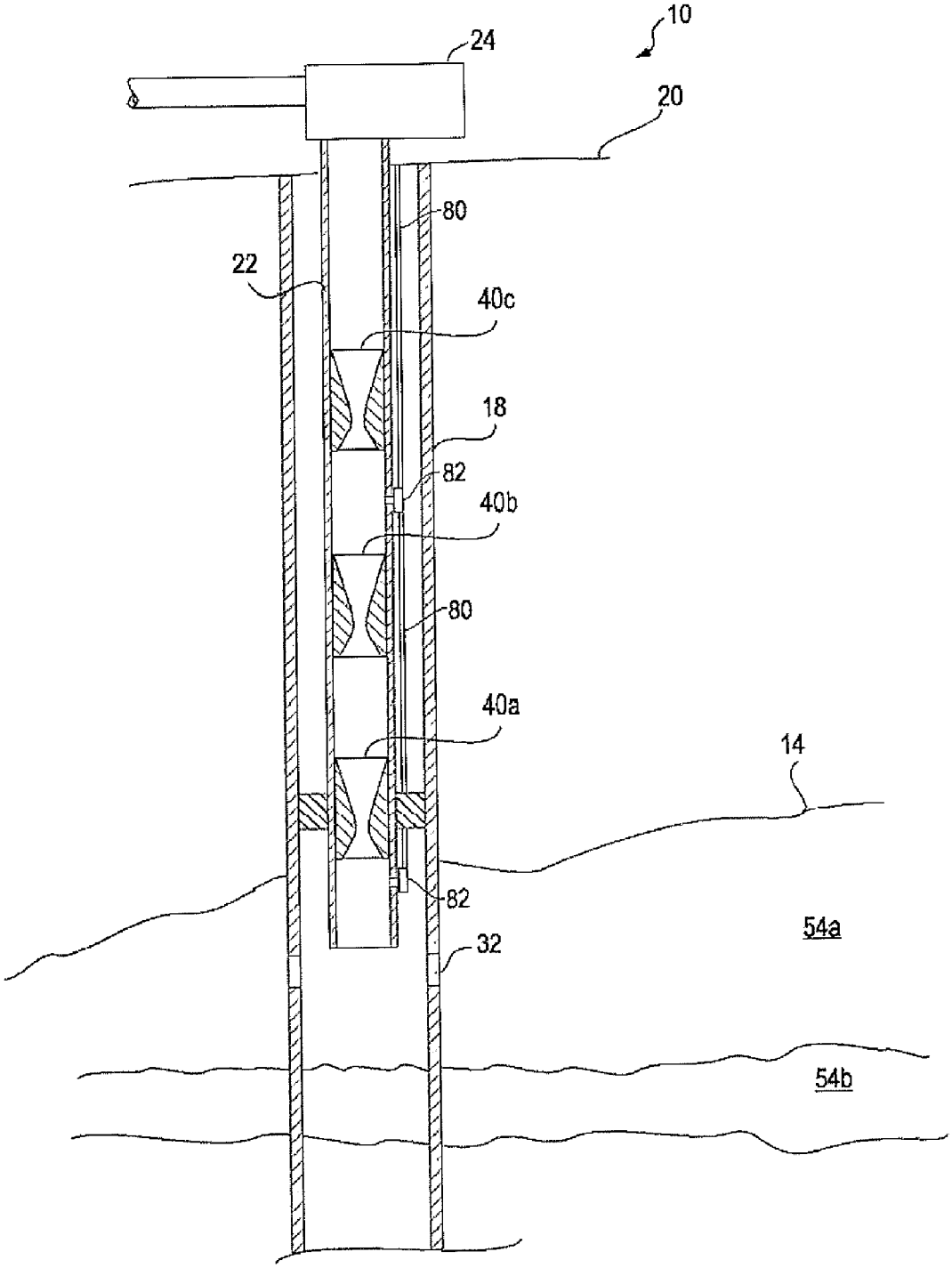
FIG. 4 is cross-sectional view illustrating a deliquification arrangement for a production well where a plurality of nozzles is disposed in the production tube.

In embodiments, the injection line 80 delivers the foaming agent from the surface through injection valve 82 into the production tube 22 downstream of the nozzle 40 (FIG. 1). In embodiments, the injection line 80 delivers the foaming agent through injection valve 82 into the passageway (e.g., at inwardly tapered inlet portion 48, outwardly tapered outlet portion 50, or venturi neck portion 52) of the nozzle 40 (FIG. 2). In embodiments, the injection line 80 delivers the foaming agent from the surface through injection valve 82 into the production tube 22 upstream of the nozzle 40 (FIG. 3). In embodiments, multiple injection valves 82 are provided for injecting foaming agent into production tube 22 for each nozzle 40 (e.g., a injection valve 82 placed both upstream and downstream of nozzle 40). Thus, the foaming agent can be delivered upstream of the nozzle 40 (e.g., the opening in the production tubing is positioned upstream of the nozzle), downstream of the nozzle 40 (e.g., the opening in the production tubing is positioned downstream of the nozzle), directly into the passageway of the nozzle 40, or a combination thereof. Furthermore, in some cases, a plurality of nozzles is disposed at spaced locations along a length of the production tube 22 such that the produced fluid passes successively through each of the nozzles. Here, the injection line 80 can deliver the foaming agent into the production tube 22 proximate to one or more of the plurality of the nozzles (FIG. 4). While a single injection line 80 is shown in FIG. 4 to supply multiple injection valves 82, one skilled in the art will appreciate that each injection valve 82 can alternatively be supplied through a separate injection line 80.

Nonetheless, the injection line 80 that delivers the foaming agent into the production tube 22 may be proximate to the at least one nozzle 40 such that mixing of the foaming agent may be increased within the production tube 22 due to agitation of the produced fluid passing through the at least one nozzle 40. For example, the at least one nozzle 40 may create better foaming action of the injected foaming agent than the foaming action of the foaming agent without the at least one nozzle 40 (e.g., merely injecting the foaming agent alone).

Referring to FIG. 2, the nozzle 40 can be formed integrally with the production tube 22 so that it is fixed in place in the tube 22. For example, the nozzle 40 and the production tube 22 can be formed as a single, unitary member. In that case, the nozzle 40 can be installed in the well 12 as the production tube 22 is installed and, if desired, removed from the well 12 along with the production tube 22.

Alternatively, the nozzle 40 can be removably disposed in the production tube 22 and can be positioned in the production tube 22 at a desired location by engaging an outer surface of the nozzle 40 to the inner surface of the production tube 22, e.g., by a frictional fit or a mechanical connection, as shown in FIG. 1. The nozzle 40 can be disposed in the production tube 22 before or after the production tube 22 is inserted into the well 12. For example, with the production tube 22 in place in the well 12, but typically with the wellhead equipment 24 uninstalled, the nozzle 40 can be lowered into the production tube 22 using a retrieval tool 60 that is inserted into the production tube 22 until the nozzle 40 is at a desired location. The retrieval tool 60 can be engaged to the nozzle 40 during installation by corresponding engagement features on the nozzle 40 and tool 60, such as a threaded inner surface 62 of the nozzle 40 that is screwed to a threaded outer surface 64 of the retrieval tool 60, as shown in FIG. 1. After the tool 60 has been used to dispose the nozzle 40 in its desired position, the tool 60 can be disengaged from the nozzle 40 and removed, leaving the nozzle 40 in place.

In some cases, it may be desirable to move or remove the nozzle 40. For example, after production of the well 12, the conditions of the well 12 may change, the understanding of the well 12 conditions may improve, and/or the nozzle 40 or other well equipment may be damaged or worn. In such cases, the wellhead equipment 24 can be removed, and the retrieval tool 60 can be inserted into the production tube 22 and engaged to the nozzle 40 so that the tool 60 can be used to either move the nozzle 40 to a different location in the production tube 22, replace the nozzle 40 with a different nozzle, or simply remove the nozzle 40 from the production tube 22.

As shown in FIG. 3, the nozzle 40 can be provided with various dimensions and configurations, depending on the particular conditions of the well 12. In particular, the length and angle of the inlet, outlet, and neck portions 48, 50, 52 can be varied. In one embodiment, the smallest inner diameter of the nozzle 40 is defined by the neck portion 52 and is less than one-fifth of an inner diameter of the production tube 22, and, in some cases, less than one-tenth of the inner diameter of the production tube 22. For example, in one embodiment, if the production tube 22 has an inner diameter of 3.5 inches, the diameter defined by the neck portion 52 of the nozzle 40 can be between about 0.1 inches and 0.5 inches, such as about 0.35 inches. Thus, for example, the region of decreased cross-sectional area may correspond to the neck portion 52 with a diameter that is between about 0.1 inches and 0.5 inches (e.g., such as about 0.35 inches), may correspond to the neck portion 52 with a diameter that is less than one-fifth of an inner diameter of the production tube 22, may correspond to the neck portion with a diameter that is less than one-tenth of an inner diameter of the production tube 22, or any combination thereof.

The length of the inlet portion 48 of the nozzle 40, as measured in the axial direction of the nozzle 40, can be shorter than the length of the outlet portion 50 of the nozzle 40, also measured in the axial direction of the nozzle 40. In one embodiment, the axial length of the inlet portion 48 can be one-half or less of the axial length of the outlet portion 50. For example, in one embodiment, the axial length of the inlet portion 48 can be about half the inner diameter of the production tube 22, and the axial length of the outlet portion 50 can be twice the diameter of the production tube 22 or more. For example, if the inner diameter of the production tube 22 is 3.5 inches, the axial length of the inlet portion 48 can be about 1.75 inches, and the axial length of the outlet portion 50 can be at least 7 inches.

If the nozzle 40 is not integral with the production tube 22, additional connection members 66 can be provided on the nozzle 40 to facilitate the engagement of the nozzle 40 with the inner surface of the production tube 22, as shown in FIG. 3. For example, the connection members 66 can be a nitrile ring or a metal slip that holds the nozzle 40 in place. In some cases, the connection members 66 can be engaged or disengaged from the inner surface of the production tube 22 by pulling with slick line or jar down to lock the nozzle.

As also illustrated in FIG. 3, different configurations can be used to provide the engagement feature of the nozzle 40. In particular, in the embodiment of the nozzle 40 illustrated in FIG. 3, the engagement feature is a circumferential slot 68 or groove extending radially outward from the inner surface 46 of the nozzle 40, proximate the second end 44 of the nozzle 40. The slot 68 is defined by a shoulder 70 that extends radially and is configured to engage a retrieval tool, e.g., by a corresponding shoulder of the retrieval tool that can be actuated radially inward and outward to selectively engage or disengage the nozzle 40 during installation and removal.

It is also appreciated that some wells may benefit from the use of more than one nozzle 40 in the production tube 22. In this regard, FIG. 4 illustrates an embodiment of a system 10 having three nozzles 40*a*, 40*b*, 40*c* disposed at spaced locations along the length of the production tube 22. The produced fluid passing through the production tube 22 passes successively through each of the nozzles 40*a*, 40*b*, 40*c*. Each nozzle 40*a*, 40*b*, 40*c* is generally configured as described above and adapted to deliquefy the produced fluid. As the produced fluid flows outside of the nozzles 40*a*, 40*b*, 40*c* (i.e., before entering the first nozzle 40*a*, between the successive nozzles 40*a*, 40*b*, 40*c*, and after exiting the last nozzle 40*c*), the produced fluid may tend to liquefy. The nozzles 40*a*, 40*b*, 40*c* can be positioned at successive lengths so that the produced fluid encounters the nozzles 40*a*, 40*b*, 40*c* after some liquefaction has occurred. Thus, the deliquefying effect provided by the nozzles 40*a*, 40*b*, 40*c* can be repeated along the production tube 22, thereby further facilitating the transmission of the produced fluid therethrough.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

Many modifications and other embodiments of the invention set forth herein will come to mind to one skilled in the art to which this invention pertains having the benefit of the teachings presented in the foregoing descriptions and the associated drawings. For example, while the drawings illustrate injection line 80 and injection valve 82, alternative configurations may deliver foaming agent without use of an injection valve 82 or simply through the annulus 30. In addition, the above-described apparatus, system and method can be combined with other production techniques (e.g., velocity or siphon strings, gas lift, wellhead compression, injection of soap sticks or foamers). Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A system for deliquification of gas production wells, the system comprising:

a production tube that receives produced fluid from a subterranean reservoir and provides a pathway for transmission of the produced fluid to a surface location, wherein the production tube is disposed within a gas production well;

at least one nozzle disposed within the production tube, the nozzle having a first end that defines an inlet, a second end distal to the first end that defines an outlet, and a passageway extending between the first end and the second end such that the produced fluid received by the inlet is delivered to the outlet, the passageway defining a region of decreased cross-sectional area that reduces the pressure of the produced fluid passing through the nozzle; and an injection line that delivers a foaming agent into the production tube proximate to the nozzle such that mixing of the foaming agent is increased within the production tube due to agitation of the produced fluid passing through the nozzle, wherein the foaming agent will improve deliquification of the gas production well by reducing surface tension and fluid density in the production tube.

2. The system according to claim 1, wherein the injection line delivers the foaming agent into the production tube upstream of the nozzle.

3. The system according to claim 1, wherein the injection line delivers the foaming agent into the production tube downstream of the nozzle.

4. The system according to claim 1, wherein the injection line delivers the foaming agent into the passageway of the nozzle.

5. The system according to claim 1, wherein the system comprises a plurality of the nozzles disposed at spaced locations along a length of the production tube such that the produced fluid passes successively through each of the nozzles.

6. The system according to claim 5, wherein the injection line delivers the foaming agent into the production tube proximate to at least two of the plurality of the nozzles.

7. The system according to claim 1, wherein the injection line comprises a capillary string coupled to the production tube.

8. The system according to claim 1, wherein the region of decreased cross-sectional area corresponds to a neck portion with a diameter that is between about 0.1 inches and 0.5 inches.

9. An apparatus for deliquification of gas production wells, the apparatus comprising:

a production tube in a gas production well that receives produced fluid from a subterranean reservoir and provides a pathway for transmission of the produced fluid to a surface location, the production tube disposed within a gas production well, and the production tube having a nozzle disposed therewithin and an opening positioned proximate to the nozzle through which a foaming agent is introduced into the production tube, the nozzle having a first end that defines an inlet, a second end distal to the first end that defines an outlet, and a passageway extending between the first end and the second end such that the produced fluid received by the inlet is delivered to the outlet, the passageway defining a region of decreased cross-sectional area that agitates the produced fluid passing through the nozzle thereby increasing mixing of the foaming agent, wherein the foaming agent will improve deliquification of the gas production well by reducing surface tension and fluid density in the production tube.

10. The apparatus according to claim 9, wherein the opening in the production tubing is positioned upstream of the nozzle.

11. The apparatus according to claim 9, wherein the opening in the production tubing is positioned downstream of the nozzle.

12. The apparatus according to claim 9, wherein the opening is positioned in the passageway of the nozzle.

13. The apparatus according to claim 9, further comprising at least two openings positioned proximate to the nozzle through which foaming agent is introduced into the production tube.

14. The apparatus according to claim 9, further comprising a plurality of nozzles disposed at spaced locations along a length of the production tube such that the produced fluid passes successively through each of the nozzles.

15. The apparatus according to claim 14, further comprising openings positioned proximate to at least two of the plurality of nozzles through which foaming agent is introduced into the production tube.

16. The apparatus according to claim 9, wherein the region of decreased cross-sectional area corresponds to a neck portion with a diameter that is less than one-fifth of an inner diameter of the production tube.

17. The apparatus according to claim 9, wherein the region of decreased cross-sectional area corresponds to a neck portion with a diameter that is less than one-tenth of an inner diameter of the production tube.

18. A method for deliquification of a gas production well, the method comprising:

providing a production tube extending from a subterranean reservoir to a surface location, wherein the production tube is disposed within a gas production well;

providing at least one nozzle disposed within the production tube, the nozzle having a first end that defines an inlet, a second end distal to the first end that defines an outlet, and a passageway extending between the first end and the second end such that the produced fluid received by the inlet is delivered to the outlet, the passageway defining a region of decreased cross-sectional area that reduces the pressure of the produced fluid passing through the nozzle;

receiving the produced fluid through the production tube along a pathway between the reservoir and the surface location such that the produced fluid passes through the nozzle;

providing an injection line that delivers a foaming agent into the production tube proximate to the nozzle; and delivering the foaming agent into the production tube proximate to the nozzle via the injection line such that mixing of the foaming agent is increased within the production tube due to agitation of the produced fluid passing through the nozzle, wherein the foaming agent will improve deliquification of the gas production well by reducing surface tension and fluid density in the production tube.

19. The method according to claim 18, wherein the step of providing the at least one nozzle comprises providing a plurality of nozzles at spaced locations along a length of the production tube such that the produced fluid passes successively through each of the nozzles.

20. The method according to claim 18, wherein the step of providing the at least one nozzle comprises lowering the nozzle into the production tube while the production tube extends between the subterranean reservoir and the surface location.

* * * * *